US005988126A

United States Patent [19]

Strauss et al.

[11] Patent Number: 5,988,126

[45] Date of Patent: Nov. 23, 1999

[54] DEVICE FOR VARYING VALVE TIMING OF GAS EXCHANGE VALVES OF EXTERNAL COMBUSTION ENGINES

[75] Inventors: Andreas Strauss, Herzogenaurach; Joachim Dietz, Frensdorf; Manfred Wilhelm, Birnbaum, all of Germany

[73] Assignee: Ina Walzlager oHG, Germany

[21] Appl. No.: 09/164,548

[22] Filed: Oct. 1, 1998

[30] Foreign Application Priority Data

Oct. 17, 1997 [DE] Germany ..... 197 45 670

[51] Int. Cl.[6] ..... F01L 1/344

[52] U.S. Cl. ..... 123/90.17; 123/90.31

[58] Field of Search ..... 123/90.12, 90.15, 123/90.17, 90.31, 90.37, 90.38

[56] References Cited

U.S. PATENT DOCUMENTS

| | | | |
|---|---|---|---|
| 5,189,999 | 3/1993 | Thoma | 123/90.17 |
| 5,301,639 | 4/1994 | Satou | 123/90.17 |
| 5,474,038 | 12/1995 | Golovatai-Schmidt et al. | 123/90.17 |
| 5,522,352 | 6/1996 | Adachi et al. | 123/90.15 |
| 5,540,197 | 7/1996 | Golovatai-Schmidt et al. | 123/90.17 |
| 5,715,780 | 2/1998 | Haller | 123/90.17 |

FOREIGN PATENT DOCUMENTS 3929623 3/1991 Germany .

*Primary Examiner*—Weiun Lo

*Attorney, Agent, or Firm*—Bierman, Muserlian and Lucas

[57] ABSTRACT

The invention concerns a device for varying the valve timing of gas exchange valves of an internal combustion engine, said device being arranged in the region of the cylinder head (1) of the internal combustion engine on a camshaft (3) and comprising an element (6) which is attached to a crankshaft of the internal combustion engine and is in driving relationship with the crankshaft through a traction element, said device further comprising an element (7) attached rotationally fast to the camshaft (3), both of said elements (6, 7) being adapted to rotate and to be fixed relative to each other between two end positions in response to an adjusting element which is hydraulically actuatable by a solenoid control valve (25). According to the invention there are fixed in axial direction of the camshaft (3), on a camshaft-remote end of the element (7) attached to the camshaft, firstly a cylindrical pressure medium adapter (10) for pressure medium supply to the device (5) and secondly, a pulse emitter wheel (19) for determining the camshaft position relative to the crankshaft position, the pressure medium adapter (10) being sealingly surrounded by a hollow cylindrical portion (22) and the pulse emitter wheel (19) being surrounded by a further hollow space (23) formed adjacent to the hollow cylindrical housing portion (22) by a housing cap (21) which is fixed on the cylinder head (1) of the internal combustion engine and in which there are also received the control valve (25) for actuating the adjusting element of the device (5) as well as the necessary pressure medium channels (26, 27) and a pulse reading device (20) which cooperates with the pulse emitter wheel (19).

7 Claims, 1 Drawing Sheet

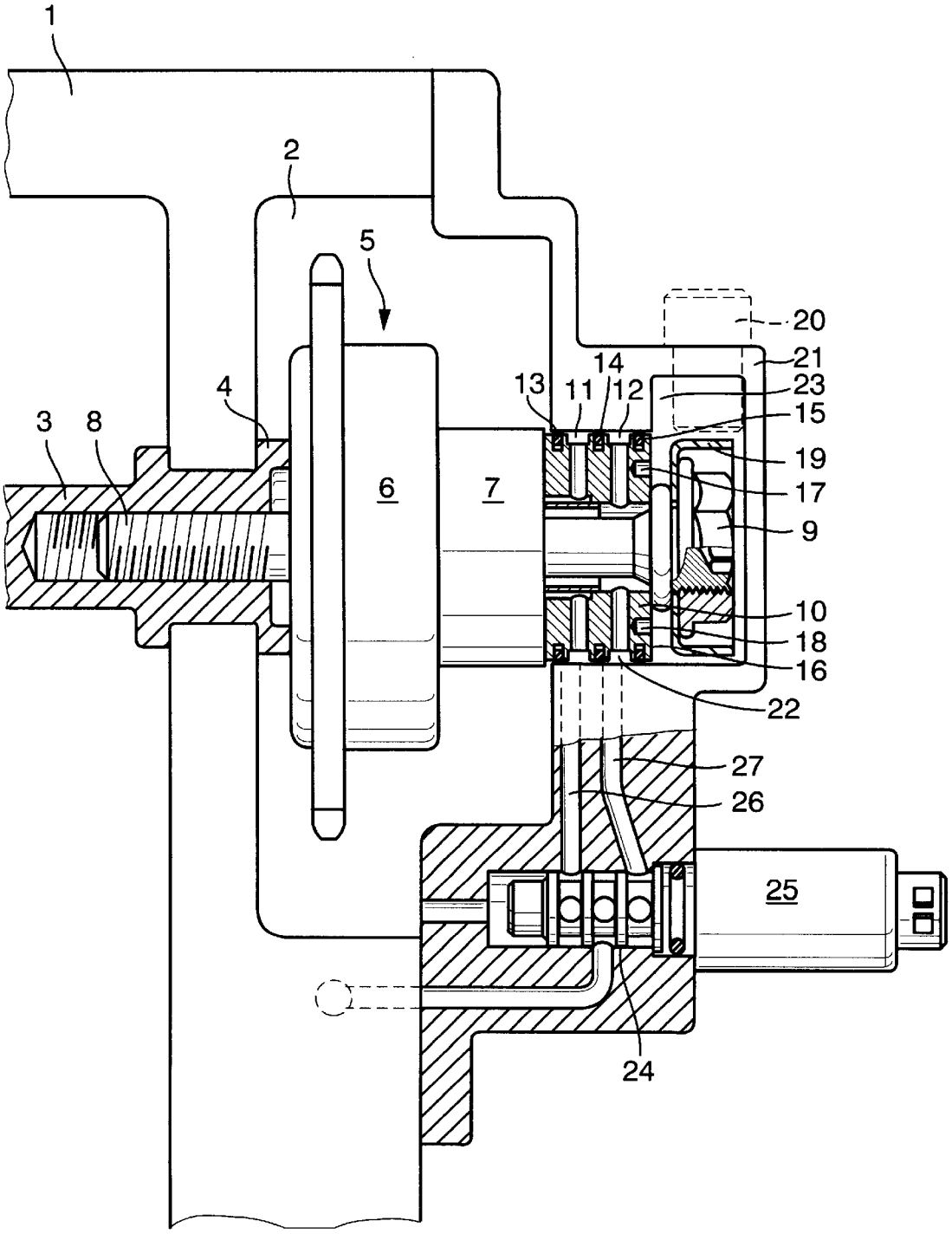
1
2
5
20
21
23
15
19
17
9
10
18
16
22
27
26
25
24
14
13
11
12
4
3
8
6
7

DEVICE FOR VARYING VALVE TIMING OF GAS EXCHANGE VALVES OF EXTERNAL COMBUSTION ENGINES

FIELD OF THE INVENTION

The invention concerns a device for varying the valve timing of gas exchange valves of an internal combustion engine, said device being arranged in the region of the cylinder head of the internal combustion engine on one end of a camshaft and comprising an element which is attached to a crankshaft of the internal combustion engine and is in driving relationship with the crankshaft through a traction element, said device further comprising an element attached rotationally fast to the camshaft by an axial fixing screw, both of said elements being adapted to rotate and to be fixed relative to each other within an adjusting range in response to an adjusting element and thus effect relative rotation between the camshaft and the crankshaft, said adjusting element being connected to a pressure medium supply while being hydraulically actuatable by a solenoid control valve.

BACKGROUND OF THE INVENTION

Variously configured devices of the pre-cited type are known in the technical field and depending on their principle of operation, they can be divided into so-called axial piston adjusting devices and so-called vane-type adjusting devices. In the case of axial piston adjusting devices, the hydraulically actuated adjusting element is constituted by an axially displaceable adjusting piston which cooperates with helical gears on the element attached to the crankshaft and on the element attached to the camshaft, while in vane-type adjusting devices, the hydraulically actuated element is constituted by a number of radial vanes on the element attached to the camshaft which are displaceable within pressure chambers in the element attached to the crankshaft.

For a supply of these devices with the required hydraulic pressure medium, the elements of such devices attached to the camshaft, independently of their principle of operation, are connected, similar to the disclosure of DE-OS 195-02 496, generally on their camshaft-proximate side to a pressure medium adapter surrounding the camshaft and comprising on its peripheral surface, annular pressure medium channels as well as pressure medium ducts starting from these annular channels and leading to the device. This pressure medium adapter is surrounded by a connecting bracket which is fixed in the cylinder head of the internal combustion engine and receives the solenoid control valve for the actuation of the adjusting piston. A pulse emitter wheel which is equally essential to the functioning of these devices and which, together with the pulse reading device serves to constantly control the position of the camshaft relative to the crankshaft, is secured in these devices in most cases to the end of the camshaft opposite the device or it is screwed together with the device on the camshaft-remote end thereof onto the camshaft.

A drawback of such solutions, however, is that the components required for the pressure medium supply and the pulse emitter wheel including the pulse reading device are arranged separately from each other on the camshaft or in the cylinder head of the internal combustion engine and thus involve a large number of individual parts which increase the costs for the modification and manufacture of an internal combustion engine intended to be equipped with a camshaft adjusting system. A further drawback has proved to be their difficult and complicated accessibility for repair and maintenance work.

Further, according to the disclosure of DE-OS 42 18 078, it is also known to supply the necessary hydraulic medium to a device for varying the timing of gas exchange valves of an internal combustion engine from its camshaft-remote end. The device is therefore arranged in continuation of the camshaft to protrude sidewards cut of the cylinder head and is surrounded by a cap. On the inner surface of the cap there is fixed concentric to the camshaft, a non-rotatable oil distributing element which is surrounded by a bushing of the element of the device attached to the camshaft and comprises separate pressure medium ducts leading to the pressure chambers of the device.

This solution likewise has the drawback that due to structural conditions, a pulse emitter wheel with the associated pulse reading device essential to the functioning of the device can be arranged on the camshaft or in the cylinder head only separately from the elements required for assuring pressure medium supply, i.e. either near the camshaft-proximate end of the device or on the end of the camshaft opposite from the device. Thus, in these solutions too, a number of individual parts are required which disadvantageously increase the costs of modifying and manufacturing an internal combustion engine intended to be equipped with a camshaft adjusting system and which, similar to the previously discussed solutions, are difficult of access for repair and maintenance.

OBJECTS OF THE INVENTION

It is an object of the invention to provide a device for varying the timing of gas exchange valves of an internal combustion engine in which the components required for pressure medium supply and the pulse emitter wheel including the pulse reading device essential to the functioning of the device can be mounted together in an economic manner on one side of the device or on one side of the cylinder head of the internal combustion engine.

This and other objects and advantages of the invention will become obvious from the following detailed description.

SUMMARY OF THE INVENTION

The invention achieves the above objects by the fact that, on the camshaft-remote end of the element attached to the camshaft there are fited in axial direction of the camshaft, firstly a cylindrical pressure medium adapter for pressure medium supply to the device and secondly, a pulse emitter wheel for determining the camshaft position relative to the crankshaft position, the pressure medium adapter being surrounded by a hollow cylindrical portion and the pulse emitter wheel being surrounded by a further hollow space formed adjacent to the hollow cylindrical housing portion by a housing cap in which there are also received the control valve for actuating the adjusting element of the device as well as the necessary pressure medium channels and a pulse reading device cooperating with the pulse emitter wheel.

In a preferred embodiment, the device is arranged in a chain shaft in the cylinder head of the internal combustion engine and is open at one end of the internal combustion engine, and this chain shaft can be sealed against leakage of pressure medium by the housing cap which is pre-assembled with the control valve and the pulse reading device. The arrangement of the device in such a chain shaft shows that due to the engine oil which is constantly present in the chain shaft, the device of the invention is mainly suitable for internal combustion engines with chain-driven camshaft or with gear-driven camshaft. However, with the help of special sealing measures, the device of the invention may also be used in internal combustion engines with belt-driven camshaft.

In a further embodiment of the device of the invention, it is additionally proposed to screw the pressure medium adapter by the axial fixing screw of the device on the camshaft and to secure the pulse emitter wheel with a separate nut on the screw head of the fixing screw. This has the advantage that when mounting the device on the internal combustion engine, the pressure medium adapter can first be screwed together with the device on the camshaft whereafter, the pulse emitter wheel can be placed on the screw head and be exactly aligned to the camshaft before it is finally screwed tight. Advantageously, the fixing screw is configured with an annular bead under its screw head, which bead then serves as a spacer between the pressure medium adapter and the pulse emitter wheel, and the radial side surfaces of the screw head are configured respectively as a pressure surface of the fixing screw bearing against the pressure medium adapter and as a contact surface for the pulse emitter wheel.

According to a further proposition of the invention, the cylindrical pressure medium adapter comprises at least two annular grooves on its outer peripheral surface which are sealed relative to each other and relative to the hollow cylindrical housing portion of the housing cap preferably, by steel sealing rings arranged next to the annular grooves in circumferential retaining grooves. These annular grooves communicate on the one hand through radial tap bores and axial pressure medium ducts with the device and on the other hand, through pressure medium ducts within the housing cap loading away from the hollow cylindrical housing portion, with the solenoid control valve of the device. The most advantageous type of control valve has proved to be a cartridge valve which is inserted into a bore extending axially parallel or at right angles to the camshaft in the housing cap, the cartridge valve, in turn, communicating through further pressure medium ducts in the housing cap and in the cylinder head of the internal combustion engine with a pressure medium pump and with a pressure medium reservoir. As an equivalent embodiment of this feature of the invention, it is also possible to arrange only the retaining grooves of the steel sealing rings and the steel sealing rings themselves in the outer peripheral surface of the pressure medium adapter and make the annular grooves for pressure medium conveyance between the stationary housing cap and the rotating pressure medium adapter in the cylindrical surface of the hollow cylindrical housing facing the outer peripheral surface of the pressure medium adapter.

According to a further feature of the invention, the pressure medium adapter comprises on its end remote from the camshaft, two coaxially extending axial pocket bores offset at 180° to each other, into which bores an auxiliary tool with a complementary configuration can be inserted for adjusting the basic position of the device. These axial pocket bores have proved to be advantageous insofar as that the basic position of the adjusting element of the device set by the screwing or the pressure medium adapter and the device to the camshaft can be fixed with the help of an auxiliary tool, e.g. a box spanner or the like having complementary fixing pins, and cannot get misadjusted when the fixing screw is tightened. In an equivalent embodiment, it is likewise possible to replace the axial pocket bores with similarly arranged fixing pins on the camshaft-remote end of the pressure medium adapter and equip the auxiliary tool with appropriate complementary insertion bores.

According to a final proposition of the invention, the pulse emitter wheel is preferably configured as a hollow cylindrical or disc-shaped formed element having a plurality of pulse-generating segments and the pulse reading device is preferably a sensor which is arranged radially of or axially parallel to the pulse emitter wheel and projects into the hollow space of the housing cap. It has proved to be particularly advantageous to configure the pulse emitter wheel in the form of a spoked wheel made by punching out of sheet metal or by combined cutting and bending. The spokes of the pulse emitter wheel then form the pulse-generating segments and their number depends basically on the number of cylinders of the internal combustion engine.

To sum up, the device of the invention for varying the timing of gas exchange valves of an internal combustion engine thus has the advantage over prior art devices that the components such as control valve, pressure medium ducts and pressure medium adapter required for the pressure medium supply of the device as well as the pulse emitter wheel and the pulse reading device which are essential to the functioning of the device, are all arranged within a housing cap on one side of the device. This dispenses with the great number of individual elements required for these components so that the costs of manufacturing and modifying an internal combustion engine to be equipped with a camshaft adjusting system are greatly reduced. Another important advantage is that, for repair and maintenance work, the aforesaid components are readily accessible from the outside or just by removing the housing cap.

BRIEF DESCRIPTION OF THE DRAWINGS

The invention will now be described more closely with reference to one example of embodiment. The attached drawing shows a partial top view of a cylinder head of an internal combustion engine having a device of the invention mounted on one end of a camshaft.

DETAILED DESCRIPTION OF THE DRAWINGS

The drawing shows a device 5 for varying the timing of gas exchange valves of an internal combustion engine. The device 6 is arranged in the region of the cylinder head 1 of the internal combustion engine on one end of a camshaft 3, The drawing only roughly indicates that this device 5 comprises an element 6 attached to a crankshaft, not shown, of the internal combustion engine and in driving relationship therewith through a traction element, not shown either, and that the device further comprises an element 7 secured rotationally fast to the camshaft 3 by an axial fixing screw 8. Both these elements 6, 7 are rotatable and fixable relative to each other between two end positions within the device 5 by an adjusting element, not shown, which is connected to a pressure medium supply and hydraulically actuatable by a solenoid control valve 25. Said elements 6 and 7 thus bring about in a known manner, a rotation of the camshaft 3 relative to the crankshaft of the internal combustion engine.

The drawing further shows that in accordance with the invention, there is fixed axially of the camshaft 3 on the camshaft-remote end of the element 7 of the device 6 attached to the camshaft, firstly a cylindrical pressure medium adapter 10 for a supply of pressure medium to the device 5 and secondly, a pulse emitter wheel 19 for determining the position of the camshaft 3 relative to the crankshaft. On the cylinder head 1 of the internal combustion engine, there is fixed a housing cap 21 which receives the control valve 25 for actuating the adjusting element of the device 6 and the required pressure medium ducts 26, 27 as also a pulse reading device 20 which cooperates with the pulse emitter wheel 19. On its inside, the housing cap 21 comprises a hollow cylindrical housing portion 22 and a further hollow space 23 arranged next to this housing portion 22. For the mounting of the device 5, the housing cap 21 is pushed over the pulse emitter wheel 19 onto the pressure medium adapter 10 so that, as can be seen in the drawing, the pressure medium adapter 10 is sealingly surrounded by the hollow cylindrical housing portion 22 of the housing cap 21 and the pulse emitter wheel 10 is arranged for rotation in the further hollow space 23 of the housing cap 21. The device 5 is arranged in a laterally open chain shaft 2 in the cylinder head 1 of the internal combustion engine, which shaft 2, on mounting of the device 5, is sealed against leakage of pressure medium by the housing cap 21 which is preassembled with the control valve 25 and the pulse reading device 20.

The drawing further shows that the pressure medium adapter 10 is screwed on the camshaft 3 together with the device 5 by the axial fixing screw 8, while the pulse emitter wheel 19 is secured by a separate nut 9 on the screw head of the fixing screw 8. In the embodiment of the device 5 of the invention shown in the drawing, the pressure medium adapter 10 comprises on its peripheral surface two annular grooves 11, 12 for conveying pressure medium, which grooves are sealed from each other and from the hollow cylindrical housing portion 22 of the housing cap 21 by steel sealing rings 13, 14, 16 arranged next to these annular grooves 11, 12 in retaining grooves, not referenced. Further, on its camshaft-remote end face 16, the pressure medium adapter 10 comprises two coaxial axial pocket bores 17, 16 which are offset to each other at 180° and into which an auxiliary tool with complementary configuration can be inserted for adjusting the basic position of the device 5.

In the present case, the control valve 25 shown in the drawing for actuating the device 5 is a cartridge valve inserted into an axially parallel bore 24, the valve being connected in a known manner to a pressure medium pump and a pressure medium reservoir by two pressure medium ducts, not referenced. Further, the pulse emitter wheel 19 is represented by way of example as a hollow cylindrical part made by cutting and bending, whose pulse-generating segments which extend spoke-like from the longitudinal axis of the camshaft 3 are registered during the operation of the internal combustion engine by a sensor indicated by chain-dotted lines, said sensor being arranged radially of the pulse emitter wheel 19 and projecting into the hollow space 23 of the housing cap 21.

We claim:

1. A device for varying valve timing of gas exchange valves of an internal combustion engine, said device being arranged in a region of a cylinder head (1) of the internal combustion engine on one end (4) of a camshaft (3) and comprising an element (6) which is attached to a crankshaft of the internal combustion engine and is in driving relationship with the crankshaft through a traction element, said device further comprising an element (7) fixedly attached to the camshaft by an axial fixing screw (8), both of said elements (6, 7) being adapted to rotate and to be fixed relative to each other within an adjusting range in response to an adjusting element and thus effect relative rotation between the camshaft and the crankshaft, said adjusting element being connected to a pressure medium supply while being hydraulically actuatable by a solenoid control valve (25), characterized in that, on a camshaft-remote end of the element (7) attached to the camshaft there are fixed in axial direction of the camshaft (3), firstly a cylindrical pressure medium adapter (10) for pressure medium supply to the device (5) and secondly, a pulse emitter wheel (19) for determining a camshaft position relative to a crankshaft position, the pressure medium adapter (10) being surrounded by a hollow cylindrical portion (22) and the pulse emitter wheel (19) being surrounded by a further hollow space (23) formed adjacent to the hollow cylindrical housing portion (22) by a housing cap (21) in which there are also received the control valve (25) for actuating the adjusting element of the device (5) as well as necessary pressure medium channels (26, 27) and a pulse reading device (20) which cooperates with the pulse emitter wheel (19).

2. A device of claim 1 wherein the device (5) is arranged in a chain shaft (2) in the cylinder head (1) of the internal combustion engine and is open at one end of the internal combustion engine, said chain shaft (2) being adapted to be sealed against leakage of pressure medium by the housing cap (21) which is pre-assembled with the control valve (25) and the pulse reading device (20).

3. A device of claim 1 wherein the pressure medium adapter (10) is screwed by the axial flexing screw (8) of the device (5) on the camshaft (3) and the pulse emitter wheel (19) is secured by a separate nut (9) on a screw head of the fixing screw (8).

4. A device of claim 1 wherein the cylindrical pressure medium adapter (10) comprises on an outer peripheral surface, at least two annular grooves (11, 12) which are sealed relative to each other and relative to the hollow cylindrical housing portion (22) of the housing cap (21) by steel sealing rings (13, 14, 15) arranged next to the annular grooves (11, 12) in circumferential retaining grooves.

5. A device of claim 1 wherein the pressure medium adapter (10) comprises on an end remote from the camshaft (3), two coaxially extending axial pocket bores (17, 18) offset at 180° to each other, into which bores (17, 18) an auxiliary tool with a complementary configuration can be inserted for adjusting a basic position of the device (6).

6. A device of claim 1 wherein the control valve (25) is configured as a cartridge valve and inserted into a bore (24) which extends axially parallel or at right angles to the camshaft (3) in the housing cap (21).

7. A device of claim 1 wherein the pulse emitter wheel (19) is configured as a hollow cylindrical or disc-shaped formed element having a plurality of pulse-generating segments and the pulse reading device (20) is configured as a sensor which is arranged radially of or axially parallel to the pulse emitter wheel (19) and projects into the hollow space (23) of the housing cap (21).

* * * * *